US007972175B2

(12) United States Patent
Chawgo

(10) Patent No.: US 7,972,175 B2
(45) Date of Patent: Jul. 5, 2011

(54) COAXIAL CABLE CONNECTOR WITH THREADED POST

(75) Inventor: Shawn Chawgo, Cicero, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/625,947

(22) Filed: Nov. 25, 2009

(65) Prior Publication Data

US 2010/0136827 A1 Jun. 3, 2010

Related U.S. Application Data

(63) Continuation of application No. 11/538,130, filed on Oct. 3, 2006, now abandoned.

(51) Int. Cl.
*H01R 9/05* (2006.01)

(52) U.S. Cl. ..... 439/583

(58) Field of Classification Search ..... 439/578, 439/584, 583

See application file for complete search history.

(56) References Cited

U.S. PATENT DOCUMENTS

| | | | | |
|---|---|---|---|---|
| 3,384,703 | A | 5/1968 | Forney, Jr. | |
| 3,390,374 | A | 6/1968 | Forney, Jr. | |
| 3,551,882 | A | 12/1970 | O'Keefe | |
| 3,644,874 | A | 2/1972 | Hutter | |
| 4,339,166 | A | 7/1982 | Dayton | |
| 4,431,255 | A * | 2/1984 | Banning | 439/578 |
| 4,755,152 | A | 7/1988 | Elliot et al. | |
| 4,854,893 | A | 8/1989 | Morris | |
| 4,990,106 | A | 2/1991 | Szegda | |
| 5,073,129 | A | 12/1991 | Szegda | |
| 5,083,943 | A | 1/1992 | Tarrant | |
| 5,127,853 | A | 7/1992 | McMills et al. | |
| 5,141,451 | A | 8/1992 | Down | |
| 5,195,906 | A | 3/1993 | Szegda | |
| 5,207,602 | A | 5/1993 | McMills et al. | |
| 5,217,393 | A | 6/1993 | Del Negro et al. | |
| 5,342,218 | A | 8/1994 | McMills et al. | |
| 5,393,244 | A | 2/1995 | Szegda | |
| 5,501,616 | A | 3/1996 | Holliday | |
| 5,609,501 | A | 3/1997 | McMills et al. | |
| 5,651,698 | A | 7/1997 | Locati et al. | |
| 5,975,949 | A | 11/1999 | Holliday et al. | |
| 6,042,422 | A | 3/2000 | Youtsey | |
| 6,089,913 | A | 7/2000 | Holliday | |
| 6,331,123 | B1 | 12/2001 | Rodrigues | |
| 6,431,911 | B2 | 8/2002 | Pitschi | |
| 6,471,545 | B1 | 10/2002 | Hosler, Sr. | |
| 6,497,587 | B2 | 12/2002 | Di Mario | |

(Continued)

OTHER PUBLICATIONS

PCT Notification of Transmittal of International Search Report and Written Opinion. PCT/US2007/079865. Date of Mailing: Mar. 17, 2008.

*Primary Examiner* — Edwin A. Leon
*Assistant Examiner* — Vanessa Girardi
(74) *Attorney, Agent, or Firm* — Schmeiser, Olsen & Watts, LLP

(57) ABSTRACT

A compression-type coaxial cable connector includes a post with at least one helical thread thereon. A typical coaxial cable includes a dielectric layer and a cable braid. The threaded post engages the coaxial cable between the cable braid and the dielectric layer, and can be installed by screwing the threaded post into the coaxial cable end.

5 Claims, 6 Drawing Sheets

U.S. PATENT DOCUMENTS

| | | | | |
|---|---|---|---|---|
| 6,602,093 | B1 | 8/2003 | Cannon | |
| 6,692,300 | B2 | 2/2004 | Kanda et al. | |
| 6,783,394 | B1 | 8/2004 | Holliday | |
| 6,808,407 | B1 | 10/2004 | Cannon | |
| 6,884,115 | B2 | 4/2005 | Malloy | |
| 6,939,169 | B2 | 9/2005 | Islam et al. | |
| 7,131,868 | B2 | 11/2006 | Montena | |
| 7,144,272 | B1 * | 12/2006 | Burris et al. | 439/578 |
| 7,179,121 | B1 * | 2/2007 | Burris et al. | 439/578 |
| 7,351,099 | B1 | 4/2008 | Amidon | |
| 7,513,796 | B2 | 4/2009 | Amidon | |
| 2007/0105437 | A1 | 5/2007 | Imamura et al. | |

* cited by examiner

COAXIAL CABLE CONNECTOR WITH THREADED POST

CROSS-REFERENCE TO RELATED APPLICATIONS

This application is a continuation of and claims priority from U.S. patent application Ser. No. 11/538,130 filed on Oct. 3, 2006 now abandoned and entitled COAXIAL CABLE CONNECTOR WITH THREADED POST, incorporated herein by reference.

FIELD OF THE INVENTION

This invention relates generally to the field of coaxial cable connectors, and more particularly to a coaxial cable connector with a threaded post.

BACKGROUND OF THE INVENTION

Several types of coaxial cable present difficulties when installing cable connectors. For cables with stiff jacketing, such as PE, an installer has to push very hard to force the post of the connector under the braid of the cable. For very small, or so-called mini cable, pushing hard on very thin cable tends to buckle and severely damage it. There are many sizes of these difficult cables in both the 75 ohm and 50 ohm industries.

U.S. Pat. No. 5,342,218 (McMills et al.) discloses a basic coaxial cable connector with a helical thread on a mandrel-post body. A problem with this connector is that the only interference fits are (1) between the collar and the outside of the coaxial cable, and (2) between the post and the cable sheath.

U.S. Pat. Nos. 5,393,244 (Szegda) and 5,195,906 (Szegda) disclose a tubular body with threads on it which make contact with the outside of the braided metallic mesh.

U.S. Pat. No. 5,609,501 (McMills et al.) discloses a coaxial cable connector mandrel body which includes a tubular portion with threads on it. This connector suffers from the same problems as the '218 connector mentioned immediately above in that the only interference fits are (1) between the collar and the outside of the coaxial cable, and (2) between the post and the cable sheath.

U.S. Pat. No. 5,651,698 (Locati et al.) discloses one set of serrations on a ferrule which come into contact with the outside of the outer cable sheath, and another set of serrations on the ferrule which come into contact with the outside of the conductive braid.

U.S. Pat. No. 3,384,703 (Forney, Jr. et al.), U.S. Pat. No. 3,390,374 (Forney Jr.), U.S. Pat. No. 3,551,882 (O'Keefe), U.S. Pat. No. 3,644,874 (Hitter), U.S. Pat. No. 4,339,166 (Dayton), U.S. Pat. No. 4,755,152 (Elliot et al.), U.S. Pat. No. 4,990,106 (Szegda), U.S. Pat. No. 5,073,129 (Szegda), U.S. Pat. No. 5,083,943 (Tarrant), U.S. Pat. No. 5,127,853 (McMills et al.), U.S. Pat. No. 5,141,451 (Down), U.S. Pat. No. 5,207,602 (McMills et al.), U.S. Pat. No. 5,217,393 (Del Negro et al.), U.S. Pat. No. 5,501,616 (Holliday), U.S. Pat. No. 6,042,422 (Youtsey), and U.S. Pat. No. 6,089,913 (Holliday) disclose a cable connector with at least one serration or ridge on an inner sleeve which enhance the interference fit between the inner sleeve and the outer braided conductor of the coaxial cable.

U.S. Pat. No. 6,431,911 (Pitschi) discloses a cable connector which has threads on a contact sleeve which makes contact with a coaxial cable between the dielectric layer and the outer sheath.

U.S. Pat. No. 6,497,587 (Di Mario) discloses a cable connector with threads on the connector which are clamped to the inside of an outer screening conductor by a connector which slides over the outer screening conductor.

SUMMARY OF THE INVENTION

Briefly stated, a coaxial cable connector includes a post with at least one helical thread thereon. A typical coaxial cable includes a dielectric layer and a cable braid. The threaded post engages the coaxial cable between the cable braid and the dielectric layer, and can be installed by screwing the threaded post into the coaxial cable end.

According to an embodiment of the invention, a coaxial cable connector for connecting to a coaxial cable includes a connector body having a first end and a second end; a fastener interoperating with the first end of the body; a compression ring mounted to the second end of the body; an electrically conductive post having a first end and a second end; at least one helical thread on the first end of the post, wherein the at least one thread assists in moving the post, with a twisting motion, between a braided layer of a coaxial cable and a dielectric layer of the coaxial cable; and a mandrel portion adjacent the second end of the post.

According to an embodiment of the invention, a method of manufacturing a cable connector includes the steps of forming a connector body having a first end and a second end; forming a one-piece post and mandrel combination from an electrically conductive material, wherein the post includes a first end and a second end; forming at least one helical thread on a portion of the post; inserting the post into the body; forming or attaching a fastener on or adjacent to and interoperating with the first end of the body; and mounting a compression ring to the second end of the body.

DETAILED DESCRIPTION OF THE PREFERRED EMBODIMENT

Figure 1:
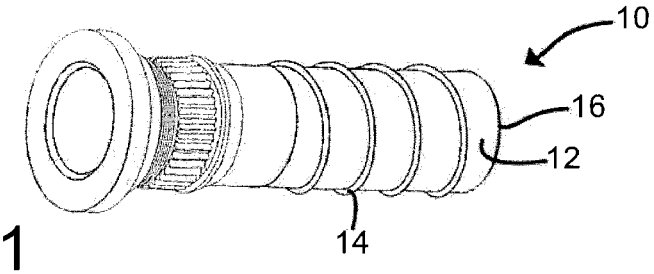
FIG. 1 shows a threaded post according to an embodiment of the present invention.
Figure 2:
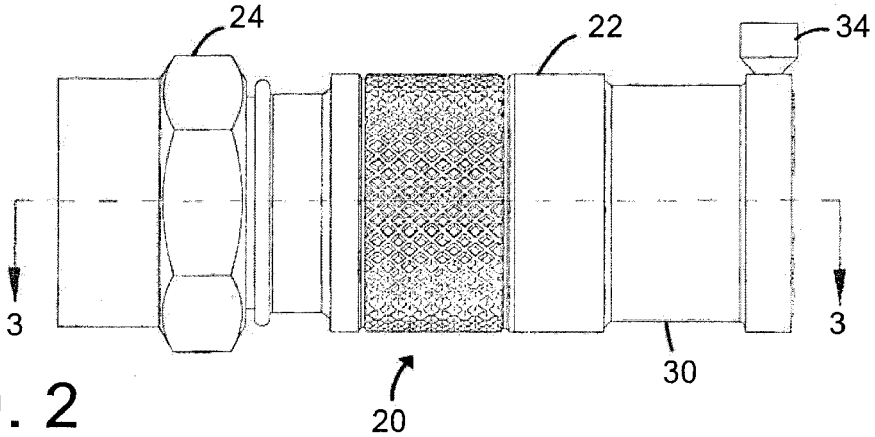
FIG. 2 shows an F-mini coaxial cable connector incorporating a threaded post according to an embodiment of the present invention.
Figure 3:
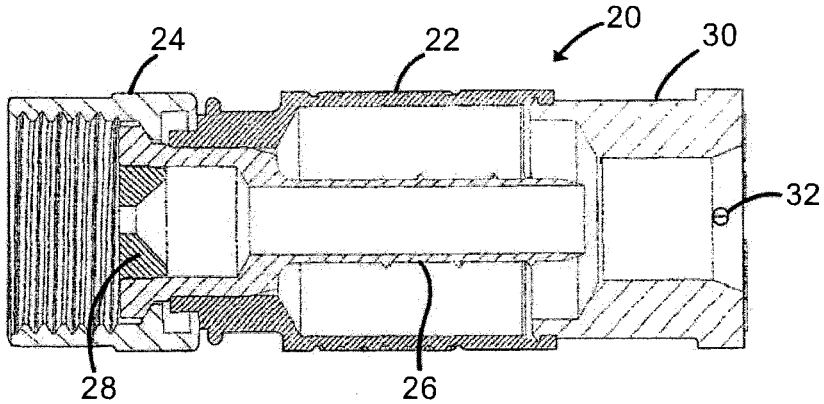
FIG. 3 shows a cross-section of the F-mini coaxial cable connector of FIG. 2.
Figure 4:
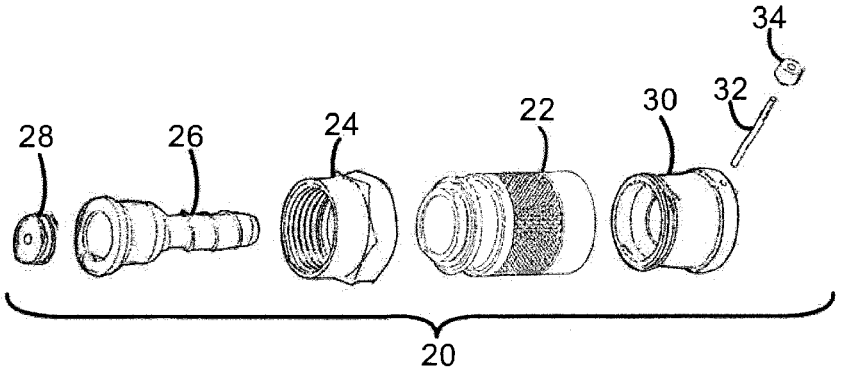
FIG. 4 shows an exploded view of the F-mini coaxial cable connector of FIG. 2.
Figure 5:
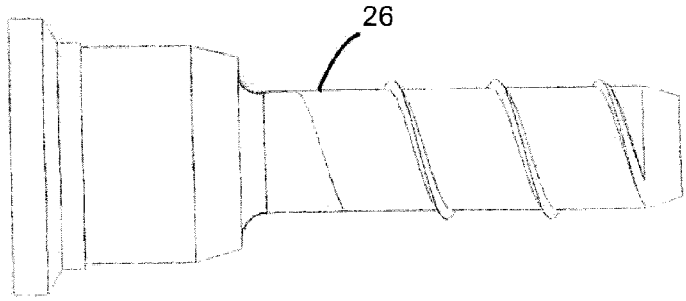
FIG. 5 shows the threaded post used in the F-mini coaxial cable connector of FIG. 2.

Referring to FIG. 1, a threaded post 10 is shown which includes a post 12 as is known within the coaxial cable connector industry, but with a helical thread 14 defined thereon. Thread 14 is intended to engage a coaxial cable between the metal foil jacket and metal ground braid of the cable. In practice, threaded post 10 is inserted into the coaxial cable with a twisting motion so that end 16 gradually engages the metal foil instead of the conventional method of pushing very hard to force an unthreaded post under the braid. For very small cable, the so called "mini" cable, using thread 14 to drive a cable connector onto the coaxial cable is very important because pushing hard on mini cable tends to buckle the mini cable and severely damage it.

There are many sizes of cables in both the 75 ohm and 50 ohm cable industries. The precise combination of pitch and thread height is determined experimentally in order to optimally balance between driving the post effectively while not cutting the metal braid. Determining the pitch and thread height does not require undue experimentation from one of ordinary skill in the art to achieve. A variety of threads such as multiple, segmented, triangular, buttress, square, and so forth are possible embodiments of the invention.

Referring to FIGS. 2-5, an F-mini coaxial cable connector 20 is shown which incorporates a threaded post 26, preferably made of brass, although any electrically conductive material would be suitable. The thread is a helical thread that preferably has a pitch of 125. Threaded post 26 is preferably a combination of a mandrel and a post as those terms are known in the art. Threaded post 26 is mounted inside a body 22, which body 22 has a fastener 24 on one end, which interoperates with the mandrel portion of threaded post 26, and a compression ring 30 on another end which interoperates with body 22. For purposes of this application, "fastener" includes a coupling nut, push and twist connection, or simply threads on a coaxial cable connector, as is the case with female threads on a female connector. An insulator 28 is preferably shaped to guide and retain a center conductor (not shown) of a coaxial cable (not shown). A contact pin 32 is preferably stored in compression ring 30 to be used by the installer to fit over the center conductor of a mini coaxial cable before inserting the cable into connector 20. A cable guide 34 holds pin 32 in compression ring 30 so it doesn't become lost before assembly.

Figure 6:
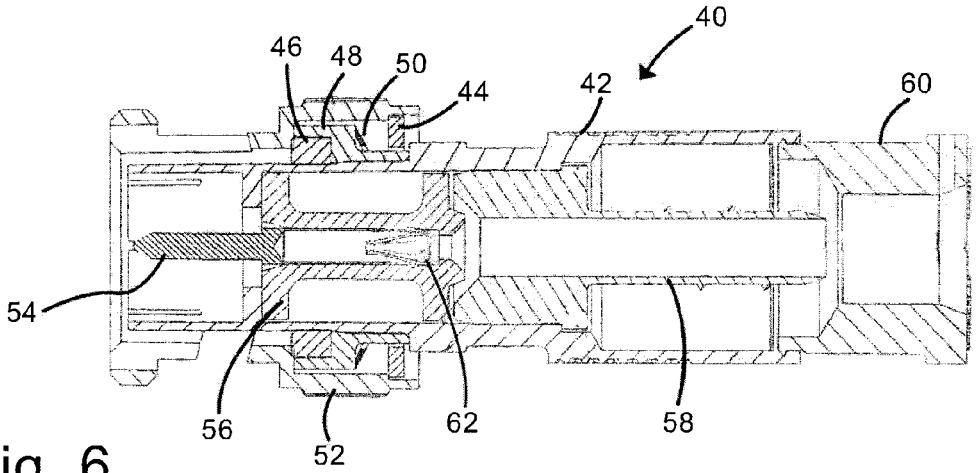
FIG. 6 shows a sectional view of a BNC compression drop connector incorporating a threaded post according to an embodiment of the present invention.
Figure 7:
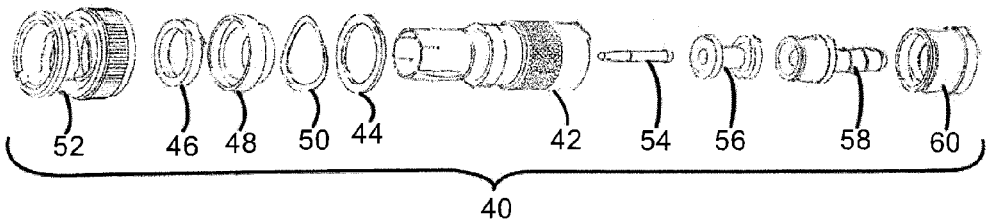
FIG. 7 shows an exploded view of the BNC compression drop connector of FIG. 6.

Referring to FIGS. 6-7, a compression-type mini BNC drop connector 40 is shown which incorporates a threaded post 58 preferably made of brass. The thread is a helical thread that preferably has a pitch of 125. Threaded post 58 is preferably a combination of a mandrel and a post as those terms are known in the art. Threaded post 58 is mounted inside a body 42, which body 42 has a fastener or BNC coupling nut 52 on one end which interoperates with body 42 via a washer 44, a conductive gasket 46, a press ring 48, and a wave spring 50, and a compression ring 60 on another end which interoperates with body 42. An insulator 56, held in place by body 42, holds a conductive pin 54 centered within body 42. A collet structure 62 in conductive pin 54 captures a center conductor of a coaxial cable (not shown) when the coaxial cable is attached to connector 40.

Figure 8:
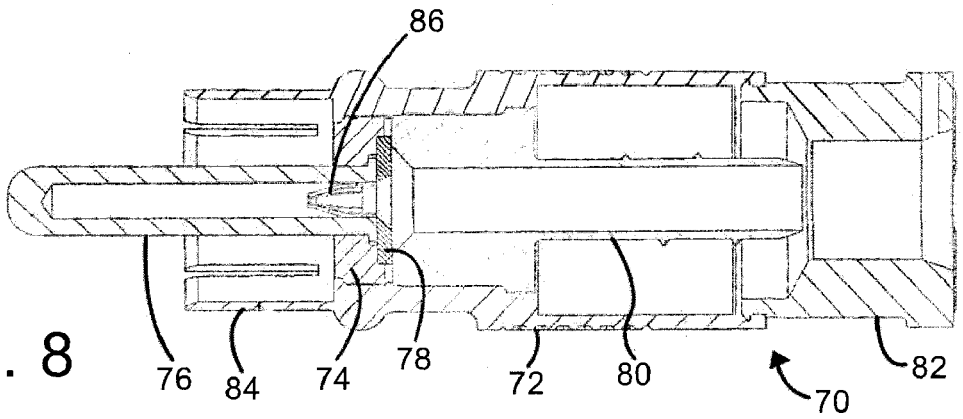
FIG. 8 shows a sectional view of a mini RCA drop connector assembly incorporating a threaded post according to an embodiment of the present invention.
Figure 9:
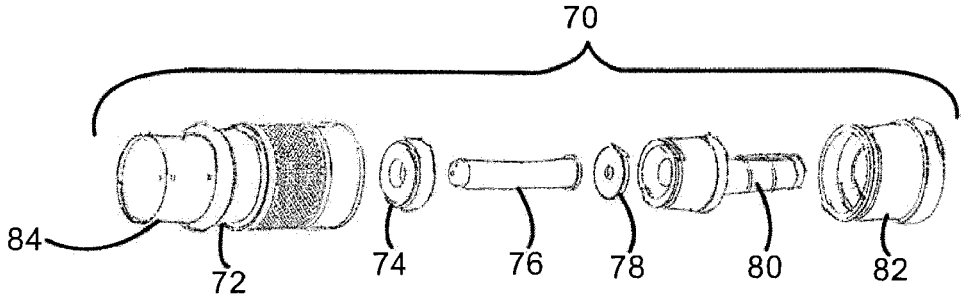
FIG. 9 shows an exploded view of the mini RCA drop connector assembly of FIG. 8.
Figure 10:
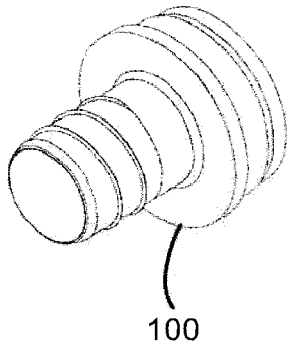
FIG. 10 shows a threaded post according to an embodiment of the present invention.
Figure 11:
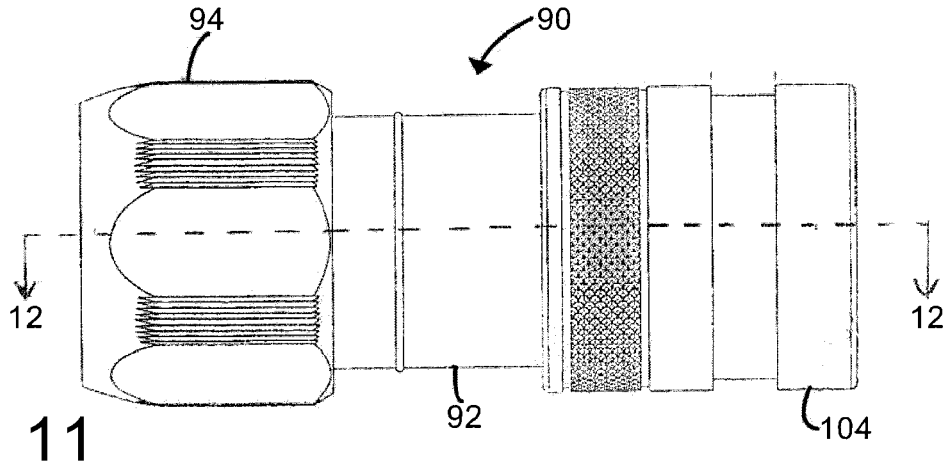
FIG. 11 shows an N-male 50 ohm connector assembly incorporating a threaded post according to an embodiment of the present invention.
Figure 12:
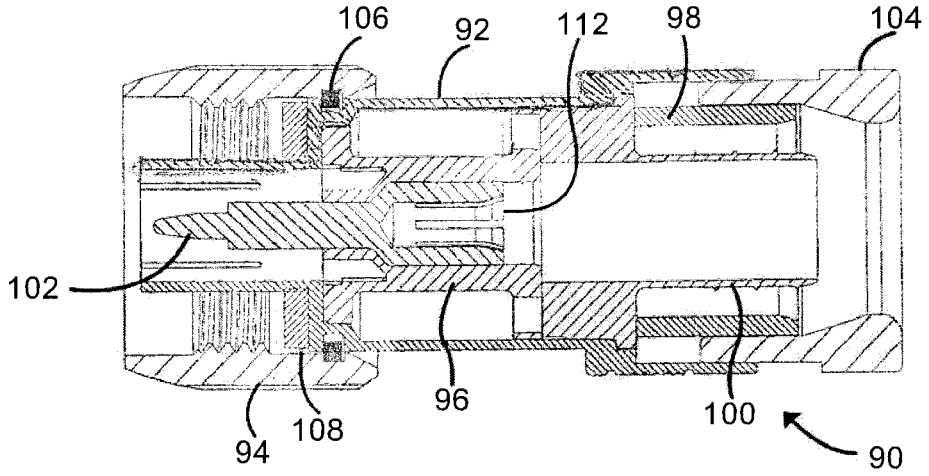
FIG. 12 shows a cross-section view of the N-male 50 ohm connector assembly of FIG. 11.
Figure 13:
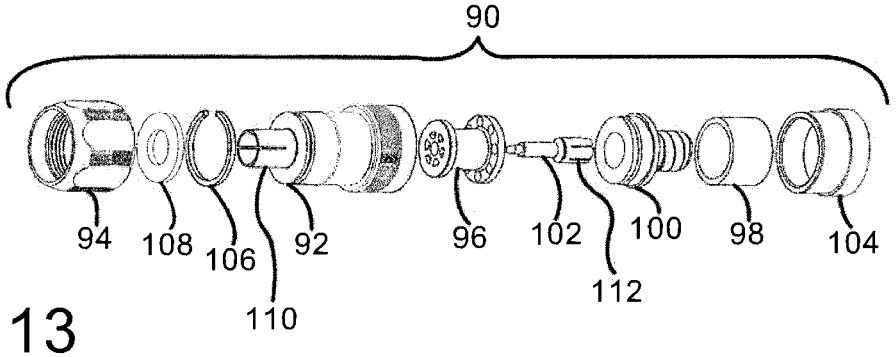
FIG. 13 shows an exploded view of the N-male 50 ohm connector assembly of FIG. 11.

Referring to FIGS. 8-9, a compression-type mini RCA connector 70 is shown which incorporates a threaded post 80 preferably made of brass. The thread is a helical thread that preferably has a pitch of 125. Threaded post 80 is preferably a combination of a mandrel and a post as those terms are known in the art. Threaded post 80 is mounted inside a body 72, which body 72 includes a fastener or RCA connector portion 84 on one end, and a compression ring 82 on another end which interoperates with body 72. An insulator 74, held in place by body 72, holds a conductive pin 76 centered within body 72. A collet structure 86 in conductive pin 76 captures a center conductor of a coaxial cable (not shown) when the coaxial cable is attached to connector 72. An insulator 78 prevents electrical contact between conductive pin 76 and threaded post 80.

Referring to FIGS. 10-13, a compression-type 50 ohm N-male connector 90 is shown which incorporates a threaded post 100 preferably made of brass. The thread is a helical thread. Threaded post 100 is preferably a combination of a mandrel and a post as those terms are known in the art. Threaded post 100 is mounted inside a body 92, which body 92 includes a 50 ohm N-male connector portion 110 on one end, and a compression ring 104 on another end which interoperates with body 92. An insulator 96, held in place by body 92, holds a contact 102 centered within body 92 and prevents electrical contact between contact 102 and threaded post 100. A collet structure 112 in contact 102 captures a center conductor of a coaxial cable (not shown) when the coaxial cable is attached to connector 92. A clamp 98 is forced by compression ring 104 onto a coaxial cable sheath (not shown) when compression ring 104 is in the compressed position. A fastener 94 is retained on body 92 by a fastener retainer 106 while a gasket 108 protects the connection between connector 90 and a 50 ohm port from the environment.

Figure 14:
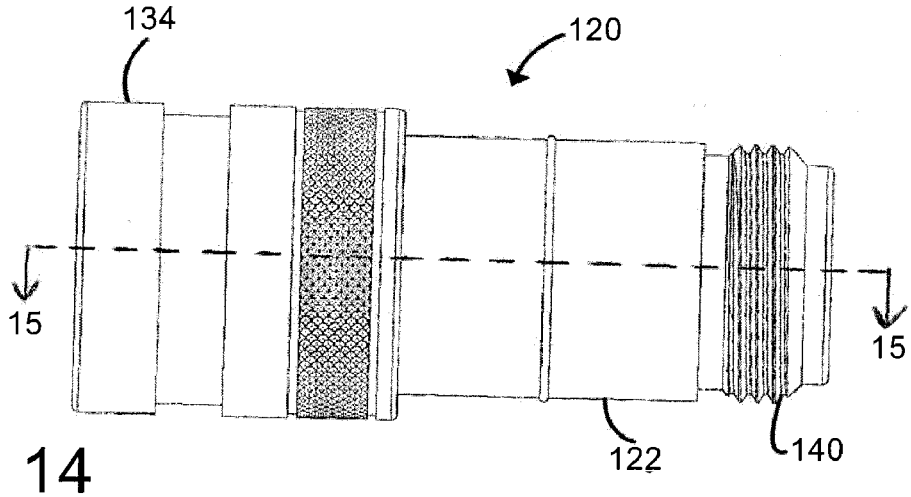
FIG. 14 shows an N-female 50 ohm connector assembly incorporating a threaded post according to an embodiment of the present invention.
Figure 15:
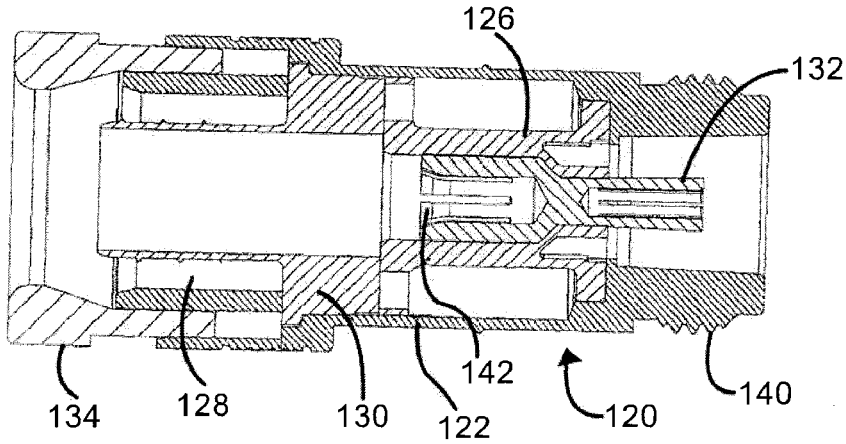
FIG. 15 shows a cross-section view of the N-female 50 ohm connector assembly of FIG. 14.
Figure 16:
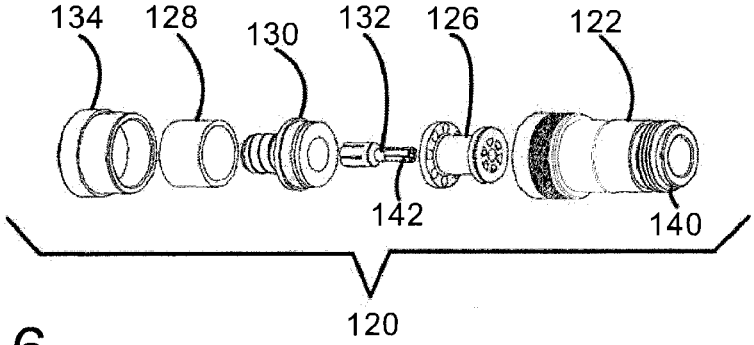
FIG. 16 shows an exploded view of the N-female 50 ohm connector assembly of FIG. 14.

Referring to FIGS. 14-16, a compression-type 50 ohm N-female cable connector 120 is shown which incorporates a threaded post 130 preferably made of brass. The thread is a helical thread. Threaded post 130 is preferably a combination of a mandrel and a post as those terms are known in the art. Threaded post 130 is mounted inside a body 122, which body 122 includes a fastener consisting of female threads 140 on one end, and a compression ring 134 on another end which interoperates with body 122. An insulator 126, held in place by body 122, holds a 50 ohm N-female contact 132 centered within body 122 and prevents electrical contact between contact 132 and threaded post 130. A collet structure 142 in contact 132 captures a center conductor of a coaxial cable (not shown) when the coaxial cable is attached to connector 120. A clamp 128 is forced by compression ring 134 onto a coaxial cable sheath (not shown) when compression ring 134 is in the compressed position.

Figure 17:
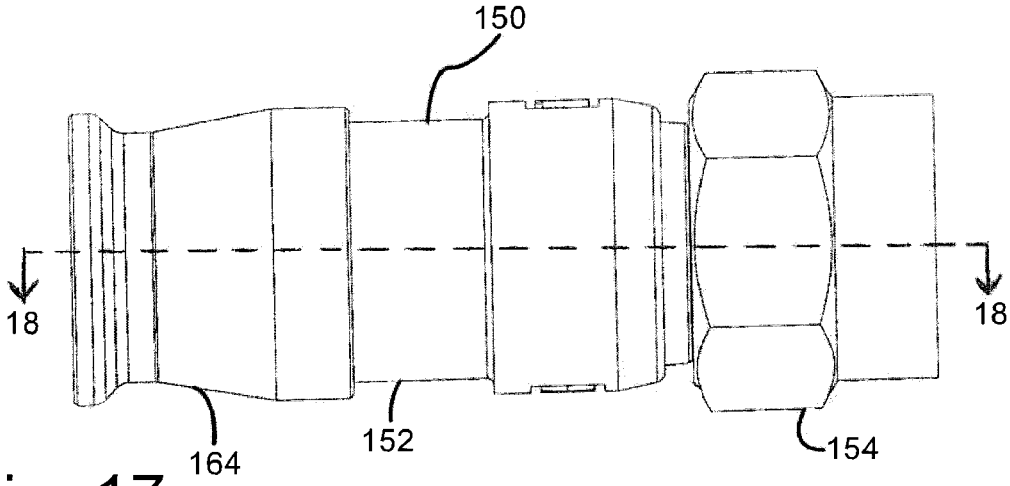
FIG. 17 shows an F compression connector assembly incorporating a threaded post according to an embodiment of the present invention.
Figure 18:
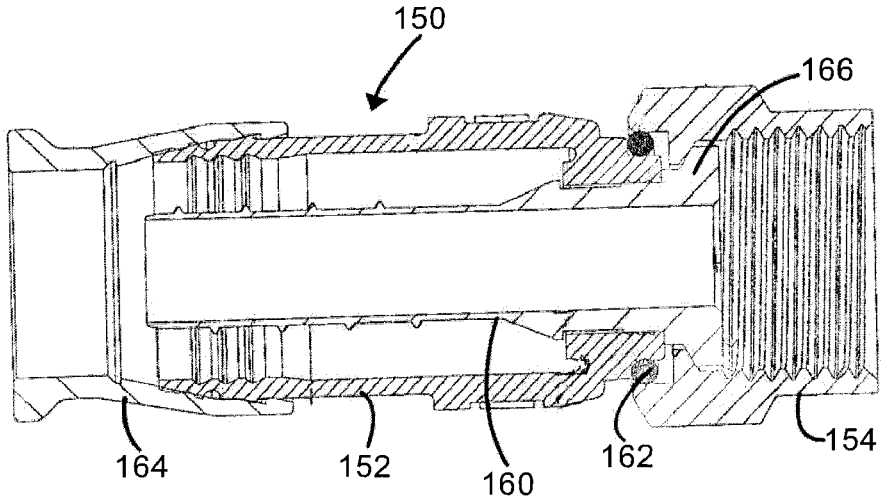
FIG. 18 shows a cross-section view of the F compression connector assembly of FIG. 17.
Figure 19:
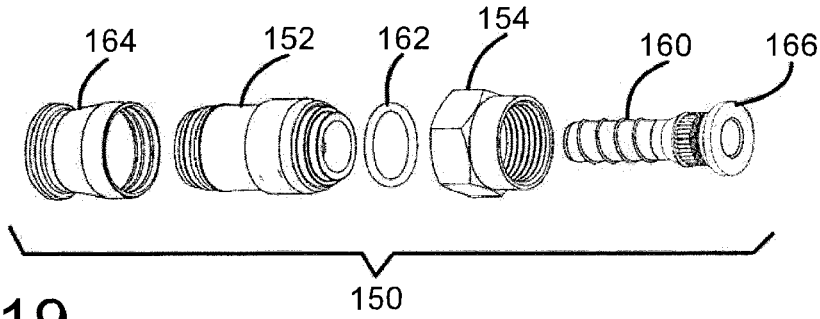
FIG. 19 shows an exploded view of the F compression connector assembly of FIG. 17.

Referring to FIGS. 17-19, an F compression coaxial cable connector 150 is shown which incorporates a threaded post 160 preferably made of brass. The thread is a helical thread. Threaded post 160 is preferably a combination of a mandrel and a post as those terms are known in the art. Threaded post 160 is mounted inside a body 152, which body 152 includes a fastener 154 on one end, which interoperates with a mandrel portion 166 of threaded post 160, and a compression ring 164 on another end which interoperates with body 152. An O-ring 162 seals the interface between fastener 154 and body 152 to keep moisture and other environmental influences out of connector 150. Compression ring 164 clamps onto a coaxial cable sheath (not shown) when compression ring 164 is in the compressed position.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A coaxial cable connector for connecting to a coaxial cable, comprising:

a connector body having a first end and a second end;

a fastener interoperating with the first end of the body;

a one-piece compression ring mounted to the second end of the body;

an electrically conductive threaded post having a first end and a second end;

the threaded post consisting of a post portion and a mandrel portion;

at least one helical thread on the first end of the post, wherein the at least one thread is adapted to assist in moving, with a twisting motion, the post between a braided layer of a coaxial cable and a dielectric layer of the coaxial cable; and the mandrel portion being adjacent the second end of the post;

an electrical insulator fitted inside the body axially adjacent the mandrel portion of the post but not surrounding or inside any part of the post portion;

an electrically conductive pin part of which is fitted inside the insulator; and a clamp fitted entirely inside a portion of the body and a portion of the compression ring;

wherein the first end of the connector body includes a 50 ohm connector portion;

wherein the conductive pin includes a collet structure at one end adapted to receive a center conductor of a coaxial cable; and wherein, when the compression ring is subjected to axial force moving the compression ring against a portion of the connector body, the interoperation between the compression ring and the connecter body is adapted to force a portion of the compression ring against an outermost layer outside of the coaxial cable with no radial compression of the compression ring.

2. A coaxial cable connector according to claim 1, wherein the connector body is electrically conductive, and wherein the fastener is electrically conductive.

3. A method of manufacturing a cable connector, comprising the steps of:

forming a connector body having a first end and a second end;

forming a one-piece post and mandrel combination, consisting of a post portion and a mandrel portion, from an electrically conductive material, wherein the post portion includes a first end and a second end;

forming at least one helical thread on the post portion;

inserting the post portion into the body;

forming or attaching a fastener on or adjacent to and interoperating with the first end of the body; and mounting a compression ring to the second end of the body;

fitting an electrical insulator inside the body axially adjacent the mandrel portion of the combination;

fitting an electrically conductive pin partly inside the insulator; and fitting a clamp entirely inside a combination of a portion of the body and a portion of the compression ring;

wherein the first end of the connector body includes a 50 ohm connector portion;

wherein the conductive pin includes a collet structure at one end adapted to receive a center conductor of a coaxial cable; and wherein, when the compression ring is subjected to axial force moving the compression ring against a portion of the connector body, the interoperation between the compression ring and the connecter body is adapted to force a portion of the compression ring against an outside of the coaxial cable with no radial compression of the compression ring.

4. A method according to claim 3, further comprising the step of fitting an electrical insulator inside the mandrel portion of the combination which prevents electrical contact between the conductive pin and the combination.

5. A method according to claim 3, wherein the connector body is electrically conductive, and wherein the fastener is electrically conductive.

* * * * *